US008246357B2

(12) United States Patent
Chen

(10) Patent No.: US 8,246,357 B2
(45) Date of Patent: Aug. 21, 2012

(54) ELECTRICAL CONNECTOR

(75) Inventor: Qi Chen, Keelung (TW)

(73) Assignee: Lotes Co., Ltd, Keelung (TW)

( * ) Notice: Subject to any disclaimer, the term of this patent is extended or adjusted under 35 U.S.C. 154(b) by 60 days.

(21) Appl. No.: 12/950,513

(22) Filed: Nov. 19, 2010

(65) Prior Publication Data

US 2012/0021614 A1 Jan. 26, 2012

(30) Foreign Application Priority Data

Jul. 22, 2010 (CN) ..... 2010 2 0271085 U

(51) Int. Cl.
*H01R 39/00* (2006.01)

(52) U.S. Cl. ..... 439/13; 439/31; 439/660

(58) Field of Classification Search ..... 439/1, 11, 439/13, 31, 660
See application file for complete search history.

(56) References Cited

U.S. PATENT DOCUMENTS 4,701,133 A * 10/1987 Worth ..... 439/13
4,975,062 A * 12/1990 Evans et al. ..... 439/13
5,542,850 A * 8/1996 Frantz ..... 439/31
6,386,884 B1 * 5/2002 Sloey ..... 439/11
7,303,401 B2 * 12/2007 Schell et al. ..... 439/65
2012/0021614 A1 * 1/2012 Chen ..... 439/13

* cited by examiner

*Primary Examiner* — James Harvey
(74) *Attorney, Agent, or Firm* — Morris, Manning & Martin, LLP; Tim Tingkang Xia, Esq.

(57) ABSTRACT

An electrical connector. In one embodiment of the present invention, the electrical connector includes a first main body, including a first insulating body and a first conductive member set fixed to the first insulating body, in which each conductive member of the first conductive member set includes a first internal connecting portion; and a second main body, including a second insulating body and a second conductive member set fixed to the second insulating body, in which each conductive member of the second conductive member set includes a second internal connecting portion, and the second internal connecting portion of each conductive member of the second conductive member set is in contact with the first internal connecting portion of the corresponding conductive member of the first conductive member set respectively. The second main body is movably mounted on the first main body and is capable of rotating relative to the first main body, and during rotation, each of the second internal connecting portions is maintained in contact with the corresponding first internal connecting portion.

16 Claims, 6 Drawing Sheets

ELECTRICAL CONNECTOR

CROSS-REFERENCE TO RELATED PATENT APPLICATION

This non-provisional application claims benefits and priority under 35 U.S.C. §119(a) on Chinese Patent Application No. 201020271085.4 filed in The People's Republic of China on Jul. 22, 2010, which is incorporated herein by reference in its entirety.

Some references, if any, which may include patents, patent applications and various publications, are cited in a reference list and discussed in the description of this invention. The citation and/or discussion of such references is provided merely to clarify the description of the present invention and is not an admission that any such reference is "prior art" to the invention described herein. All references, if any, listed, cited and/or discussed in this specification are incorporated herein by reference in their entireties and to the same extent as if each reference was individually incorporated by reference.

BACKGROUND OF THE PRESENT INVENTION

1. Field of the Invention

The present invention relates to an electrical connector.

2. Description of the Related Art

A motherboard of a computer is provided with a plurality of electrical connectors respectively for electrically connecting to other electronic components such as memory sticks and cable plugs. Along with the development of miniature computers, components on the motherboard are arranged in a more compact way. Therefore, the electrical connectors on the motherboard are designed to be arranged horizontally, vertically or even at other angles, even if the electrical connectors are of the same type.

Currently, the manufacturers of electrical connectors use different manufacturing methods respectively for electrical connectors at different angles. For each angle, one type of electrical connectors is manufactured. As a result, different sets of molds are required for manufacturing, which causes a high manufacturing cost.

Therefore, a heretofore unaddressed need exists in the art to address the aforementioned deficiencies and inadequacies.

SUMMARY OF THE PRESENT INVENTION

In one aspect, the present invention is directed to an electrical connector, which provides for separate manufacture of the same parts of the same type at different angles.

In one embodiment, the present invention adopts the following inventive measures and provides an electrical connector that includes: a first main body, including a first insulating body and a first conductive member set fixed to the first insulating body, in which each conductive member of the first conductive member set includes a first fixing portion fixed to the first insulating body, and a first internal connecting portion and a first external connecting portion respectively extending from two opposite ends of the first fixing portion; and a second main body, including a second insulating body and a second conductive member set fixed to the second insulating body, in which each conductive member of the second conductive member set includes a second fixing portion fixed to the second insulating body, and a second internal connecting portion and a second external connecting portion respectively extending from two opposite ends of the second fixing portion, and the second internal connecting portion of each conductive member of the second conductive member set is in contact with the first internal connecting portion of the corresponding conductive member of the first conductive member set respectively. The second main body is movably mounted on the first main body and is capable of rotating relative to the first main body, and during rotation, each of the second internal connecting portions is maintained in contact with the corresponding first internal connecting portion.

As compared with the prior art, in one embodiment of the present invention, the second main body is movably mounted on the first main body and is capable of rotating relative to the first main body, and during rotation, each of the second internal connecting portions is maintained in contact with the corresponding first internal connecting portion, so that with such a structure, the second main body and the first main body can be maintained at the pre-determined position simply through a fixing structure. The method of separately manufacturing the same parts of the same type at different angles can save the cost of molds and satisfy the flexible demands of customers.

These and other aspects of the present invention will become apparent from the following description of the preferred embodiment taken in conjunction with the following drawings and their captions, although variations and modifications therein may be affected without departing from the spirit and scope of the novel concepts of the disclosure.

BRIEF DESCRIPTION OF THE DRAWINGS

The drawings described below are for illustration purposes only. The drawings are not intended to limit the scope of the present teachings in any way.

DETAILED DESCRIPTION OF THE PRESENT INVENTION

Figure 1:
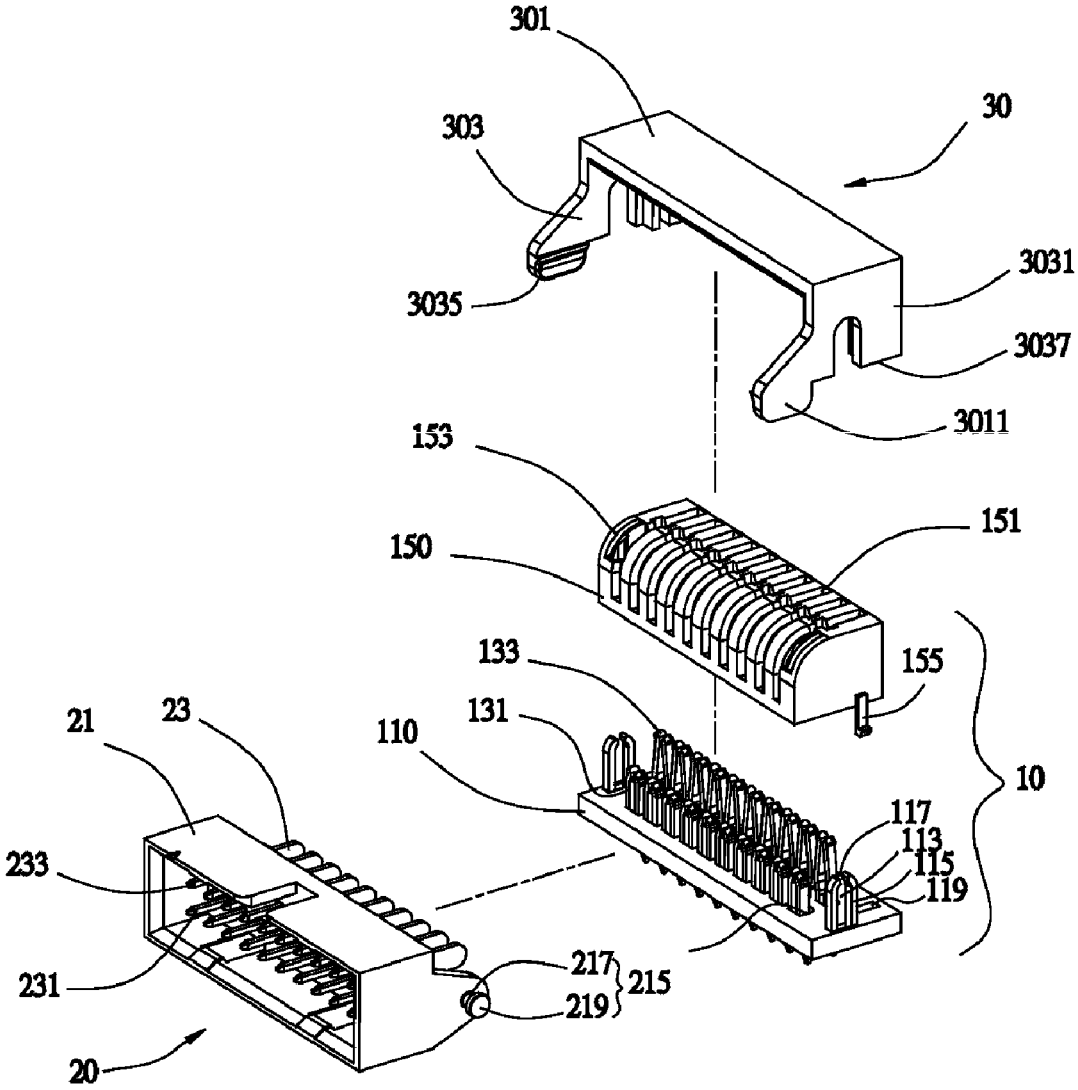
FIG. 1 is a three-dimensional exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, FIGS. 1-5, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention. Additionally, some terms used in this specification are more specifically defined below.

Definitions

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

A list of reference numerals with corresponding components as shown in the drawings is given below only for the purpose of a reader's convenience:

| | | | | | | | |
|---|---|---|---|---|---|---|---|
| First main body | 10 | First insulating body | 11 | Base | 110 | Core | 150 |
| First conductive member fixing hole | 111 | Claw | 113 | Rotating slot | 115 | Opening | 117 |
| Clamping slot | 119 | First conductive member set | 13 | First fixing portion | 132 | First internal connecting portion | 134 |
| First external connecting portion | 136 | Arm | 138 | Receiving housing | 151 | Arc shaped surface | 153 |
| Clamping column | 155 | Second main body | 20 | Second insulating body | 21 | Second conductive member fixing hole | 211 |
| Extending portion | 213 | Rotating shaft | 215 | Shaft portion | 217 | Flange portion | 219 |
| Second conductive member set | 23 | Second fixing portion | 232 | Second internal connecting portion | 234 | Second external connecting portion | 236 |
| Casing | 30, 40 | Plate body | 301 | Limiting portion | 3011, 407 | Base body | 3031 |
| Projecting portion | 3033 | Hook portion | 3035 | Stopping surface | 3037, 409 | Front plate | 401 |
| Back plate | 403 | Side plate | 405 | Buckling portion | 411 | | |

To make the objectives, structures, features and effects of the present invention more comprehensible, an electrical connector according to various embodiments of the present invention is further described in detail below with reference to the accompanying drawings and specific embodiments.

Figure 2:
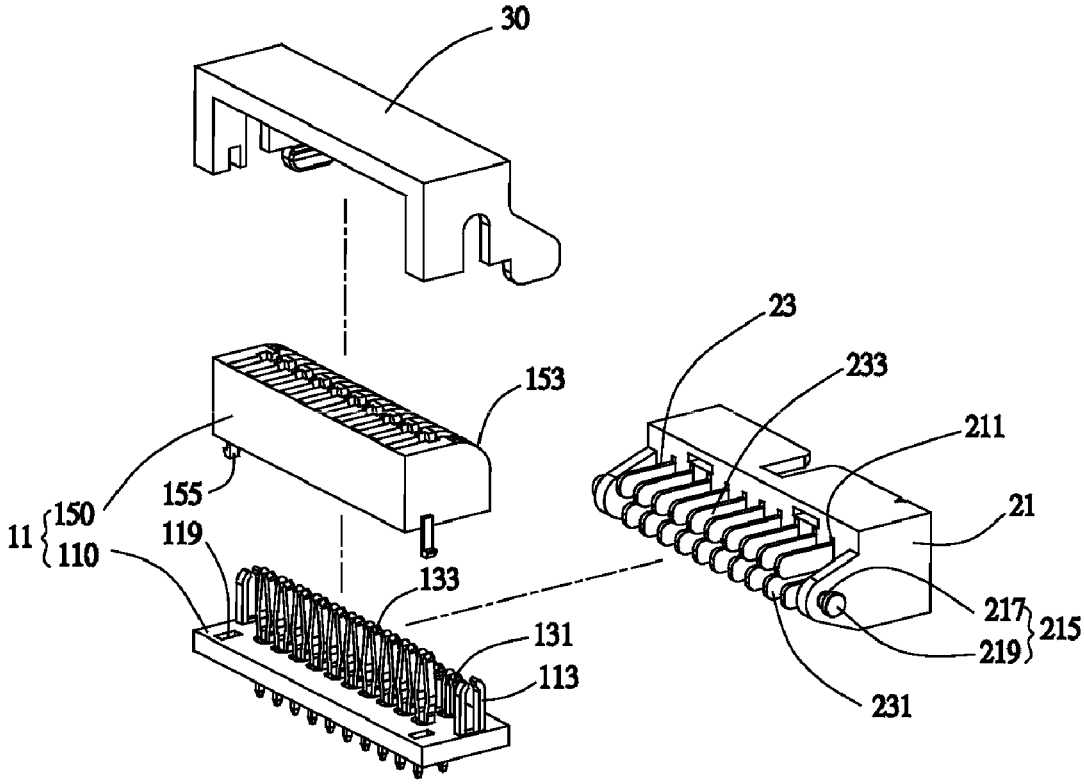
FIG. 2 is a three-dimensional exploded view of the electrical connector in FIG. 1 from another angle of view.

Referring to FIGS. 1 and 2, an electrical connector according to one embodiment of the present invention includes a first main body 10, a second main body 20 and a casing 30. The first main body 10 includes a first insulating body 11 and a first conductive member set 13 fixed to the first insulating body 11.

The first insulating body 11 includes a base 110 and a core 150 fixed on the base 110. The base 110 is in a plate shape, and is provided with a plurality of first conductive member fixing holes 111 for fixing the first conductive member set 13. Two ends of a top surface of the base 110 respectively extend vertically upwards to form two opposing claws 113, and the two claws 113 form a rotating slot 115. Tail ends of the two claws 113 extend towards each other to form an opening 117 having a small size. Two ends of the base 110 are further respectively provided with a clamping slot 119 formed through the top and bottom surfaces. The core 150 is substantially in a cuboidal shape and is provided with a plurality of receiving housings 151, and each receiving housing 151 is opened upwards and then forwards to provide a space for the second conductive member set 23 to rotate from a horizontal position to a vertical position. An arc-shaped surface 153 is formed at a junction between a front end surface and a top surface of the core 150, and a clamping column 155 extends downwards from each of two sides of the core 150. The position of the clamping column 155 is corresponding to the clamping slot 119, and during assembly, the clamping column 155 is buckled and fixed in the clamping slot 119, so as to fix the core 150 and the base 110 together. In this embodiment, the first insulating body 11 includes two components, i.e., the base 110 and the core 150, which facilitates manufacturing and assembly to the first conductive member set 13. Optionally, if the structure permits, the base 110 and the core 150 may also be integrated to form a unity.

Figure 3:
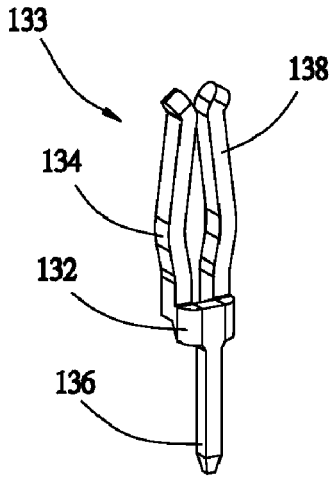
FIG. 3 is a three-dimensional view of an outer conductive member of a first conductive member set of the electrical connector in FIG. 1.
Figure 4:
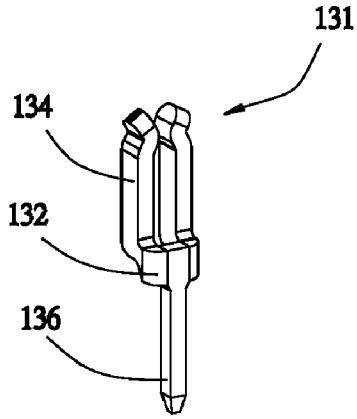
FIG. 4 is a three-dimensional view of an inner conductive member of the first conductive member set of the electrical connector in FIG. 1.

Referring to FIGS. 3 and 4, the first conductive member set 13 is formed in two rows (definitely may be formed in one row or more than two rows), which are respectively named as inner conductive members 131 and outer conductive members 133 (see FIG. 1). Each conductive member of the first conductive member set 13 includes a first fixing portion 132 fixed to the first insulating body 11, and a first internal connecting portion 134 and a first external connecting portion 136 respectively extending from two opposite ends of the first fixing portion 132. Each the first internal connecting portion 134 includes two arms 138 bent and extending from two sides of the first fixing portion 132, and the two arm 138 have opposite surfaces forming contact surfaces. The area of the contact surface is large, and since the two sides are contacted at the same time, the reliability of contact is increased. The first internal connecting portion 134 of the outer conductive member 133 unfolds outwards at a position near the first fixing portion 132 to form a large space.

Then, referring to FIGS. 1 and 2, the second main body 20 includes a second insulating body 21 and a second conductive member set 23 fixed to the second insulating body 21. The second insulating body 21 is substantially in a box shape, and is provided with a plurality of second conductive member fixing holes 211 at a middle part of a bottom thereof to fix the second conductive member set 23. Two ends of the bottom further extend to form extending portions 213, and a tail end of the extending portion 213 is provided with a rotating shaft 215. The rotating shaft 215 includes a shaft portion 217 extending outwards from two sides of the main body of the second insulating body 21 and a flange portion 219 extending from a tail end of the shaft portion 217. The width of the rotating slot 115 of the first insulating body 11 is greater than the diameter of the shaft portion 217 but is smaller than the width of the flange portion 219, so that the shaft portion 217 can rotate in the rotating slot 115 without disengaging from the rotating slot 115 in the horizontal direction. The diameter of the shaft portion 217 is greater than the size of the opening 117, so as to prevent the shaft portion 217 from disengaging from the rotating slot 115 in the vertical direction. The above structures enable the second main body 20 to be movably mounted on the first main body 10 and enable the second main body 20 to rotate relative to the first main body 10. Thus, the rotating slots 115 configured on the first insulating body 11 and the corresponding rotating shafts 215 configured on the second insulating body 21 form the rotation mechanism for enabling the second main body 20 to rotate relative to the first main body 10.

Figure 5:
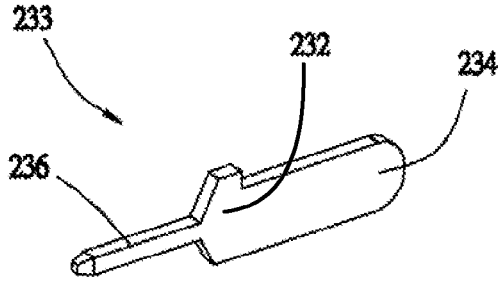
FIG. 5 is a three-dimensional view of an outer conductive member of a second conductive member set of the electrical connector in FIG. 1.
Figure 9:
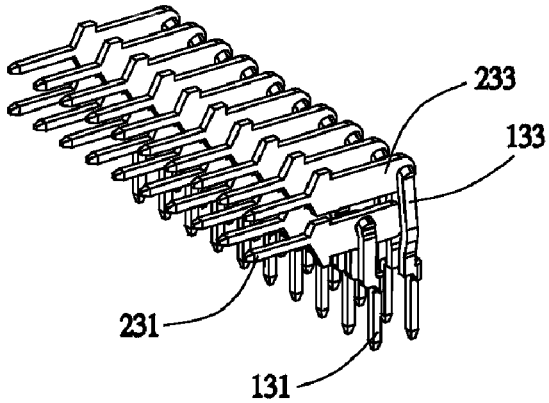
FIG. 9 is a three-dimensional assembled view of conductive members of the electrical connector in FIG. 1.

The second conductive member set 23 is also formed in two rows (definitely may be formed in one row or more than two rows) corresponding to the first conductive member set 13, which are respectively named as inner conductive members 231 and outer conductive members 233 (see FIG. 1). Referring to FIG. 5, each conductive member of the second conductive member set 23 includes a second internal connecting portion 234, a second external connecting portion 236 and a second fixing portion 232 defined between the second internal connecting portion 234 and the second external connecting portion 236. The second fixing portion 232 is fixed to the second insulating body 21. After assembly, the second internal connecting portion 234 of each conductive member of the second conductive member set 23 is in contact with the first internal connecting portion 134 of the corresponding conductive member of the first conductive member set 13 respectively, and in particular, the outer conductive members 233 of the second conductive member set 23 are connected to the outer conductive members 133 of the first conductive member set 13, and the inner conductive members 231 of the second conductive member set 23 are connected to the inner conductive members 131 of the first conductive member set 13 (see FIG. 9). The second internal connecting portion 234 is in a flat plate shape with a plate surface forming a contact surface. The area of the plate surface is large, so that during rotation, each of the second internal connecting portions 234 is maintained in contact with the corresponding first internal connecting portion 134.

The casing 30 includes a plate body 301 and arms 303 extending downwards from two ends of the plate body 301. A front end of the plate body 301 is provided with a limiting portion 3011, and the arm 303 includes a plate-shaped base body 3031 and a projecting portion 3033 extending downwards from one side of the base body 3031. The projecting portion 3033 is provided with a hook portion 3035. The bottom of the plate-shaped base body 3031 forms a stopping surface 3037.

Figure 6:
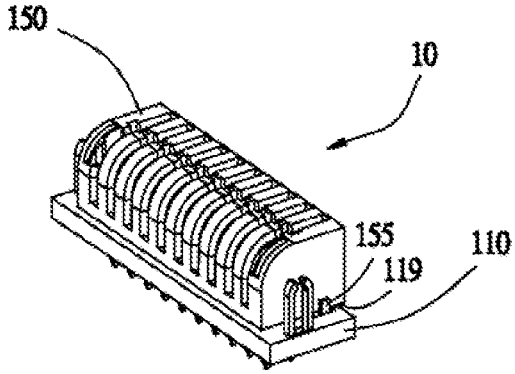
FIG. 6 is a three-dimensional assembled view of a first main body of the electrical connector in FIG. 1.

During assembly, first, the first conductive member set 13 is fixed to the base 110, and then the core 150 is installed and fixed on the base 110 through combination of the clamping columns 155 and the clamping slots 119, so as to form the first main body 10 (see FIG. 6).

Then, the second conductive member set 23 is fixed on the second insulating body 21 to form the second main body 20.

Afterwards, the first main body 10 and the second main body 20 are combined, during which the shaft portion 217 is engaged in the rotating slot 115 through the opening 117, so that the second main body 20 is movably mounted on the first main body 10 and is capable of rotating relative to the first main body 10. At this time, the second internal connecting portion 234 of each conductive member of the second conductive member set 23 is in contact with the first internal connecting portion 134 of the corresponding conductive member of the first conductive member set 13 respectively, and during rotation of the second main body 20 relative to the first main body 10, each of the second internal connecting portions 234 is maintained in contact with the corresponding first internal connecting portion 134. The arc-shaped surface 153 on the core 150 can support the second insulating body 21 when the second main body 20 rotates. As described above, the first internal connecting portion 134 of the outer conductive member 133 of the first conductive member set 10 unfolds outwards at a position near the first fixing portion 132 to form a large space, and the space should be capable of receiving the second internal connecting portion 234 of the inner conductive member 231 of the second conductive member set 20, so as to prevent the outer conductive member 133 of the first conductive member set 10 from contacting the inner conductive member 231 of the second conductive member set 20 when the second main body 20 rotates.

Figure 7:
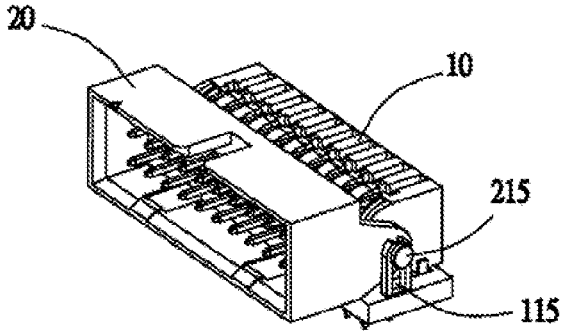
FIG. 7 is a three-dimensional view of the first main body and a second main body of the electrical connector in FIG. 1 after assembled.
Figure 8:
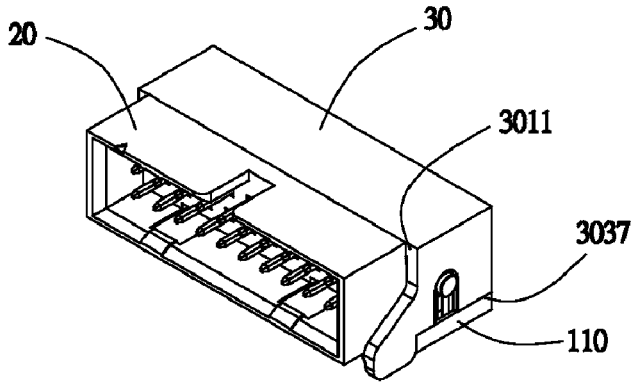
FIG. 8 is a three-dimensional assembled view of the electrical connector in FIG. 1.
Figure 10:
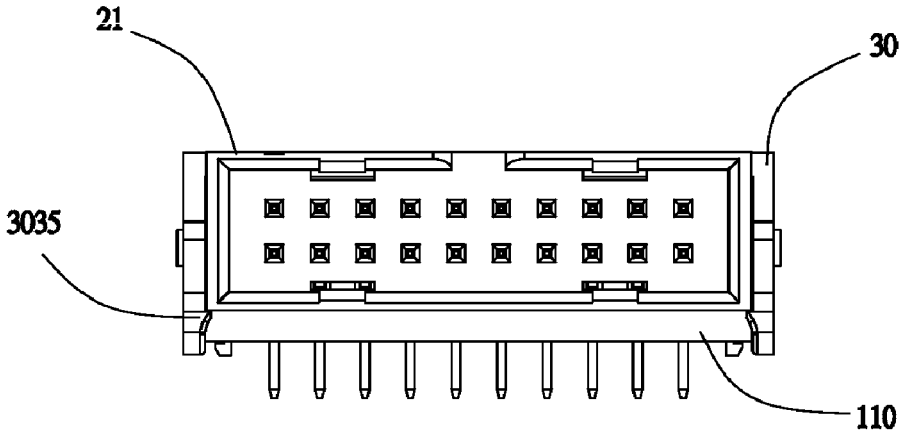
FIG. 10 is a front view of FIG. 8.
Figure 11:
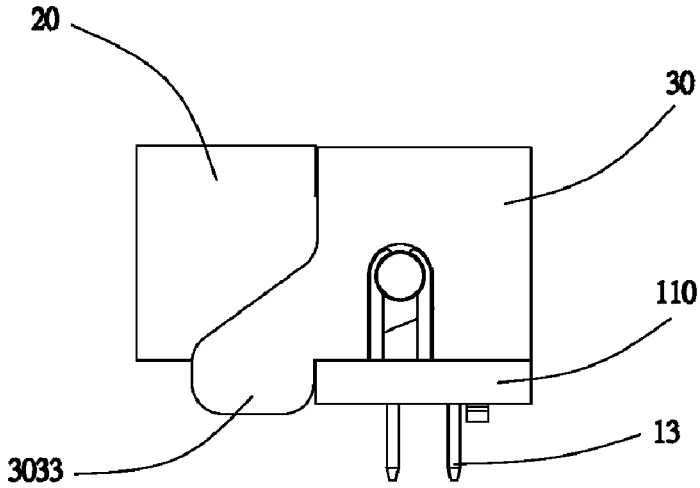
FIG. 11 is a side view of FIG. 8.

Finally, the second main body 20 is rotated to a first position where the second main body 20 is at an angle of 90° from the first main body 10 (see FIG. 7, i.e., the horizontal position), and the casing 30 is covered, so that the hook portions 3035 are hooked to the lower part of the second insulating body 21 (see FIG. 10), and the two are fixed. At the same time, the stopping surfaces 3037 are adjacent to the top surface of base 11 (or other parts of the first main body 10), and the limiting portion 3011 is adjacent to the back side of the second main body 20, so as to prevent the second main body 20 from rotating, thereby maintaining the second main body 20 at the first position (see FIG. 8). A bottom surface of the projecting portion 3033 may be designed to be located at the lowest position except for the first conductive member set 13 (see FIG. 11) to form a foot, so that when the electrical connector is soldered to a circuit board (not shown), a certain gap is kept between the bottom surface of the base 110 and the circuit board, thereby ensuring the reliability of soldering.

FIGS. 12 to 15 illustrate an electrical connector according to a second embodiment of the present invention. The difference between the second embodiment and the first embodiment lies in that a different casing structure is used, and the second main body is located at a different position during assembly.

Figure 12:
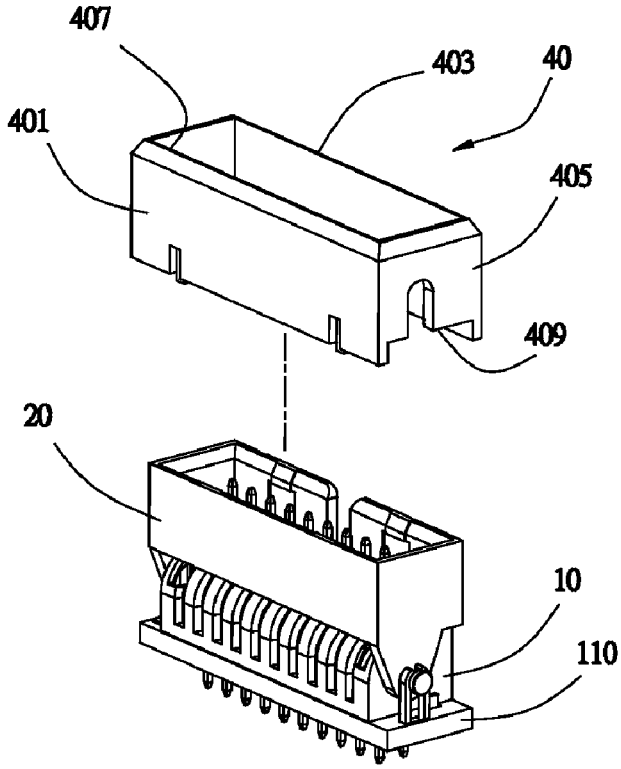
FIG. 12 is a three-dimensional exploded view of an electrical connector according to a second embodiment of the present invention.
Figure 13:
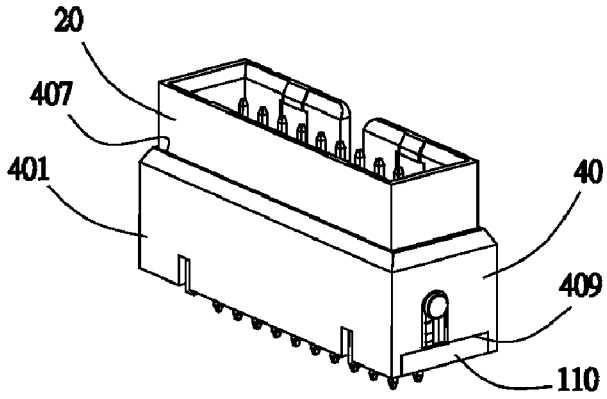
FIG. 13 is a three-dimensional assembled view of the electrical connector in FIG. 12.
Figure 14:
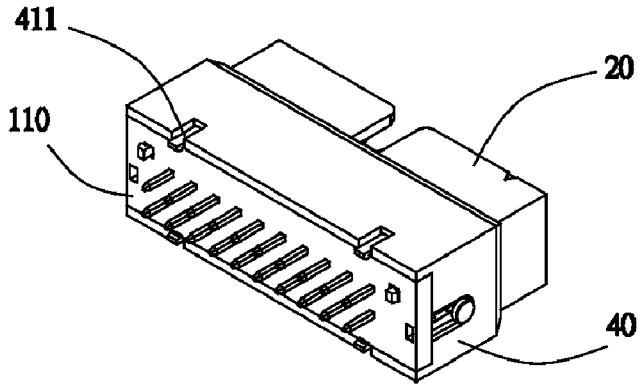
FIG. 14 is a three-dimensional assembled view of the electrical connector in FIG. 12 from another angle of view.

Referring to FIG. 12, the casing 40 is a frame hollowed out from top to bottom, and includes a front plate 401, a back plate 403 and two side plates 405 connecting the front plate 401 and the back plate 403. The front plate 401 is provided with a limiting portion 407 on an inner side thereof, and the limiting portion 407 is adjacent to an outer side of the second main body 20 after assembly (see FIG. 13). A bottom of the side plate 405 is provided with a stopping surface 409, and the stopping surface 409 is adjacent to the top surface of the base (see FIG. 13, or other parts of the first main body 10) after assembly. The front plate 401 and the back plate 403 respectively extend downwards to form a buckling portion 411 for being buckled and fixed to the first main body 10 (see FIG. 14).

Figure 15:
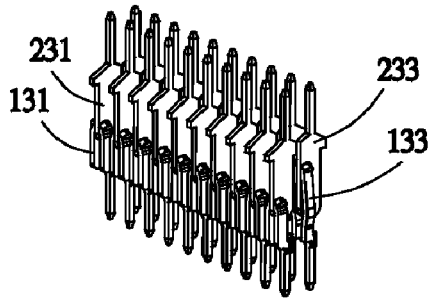
FIG. 15 is a three-dimensional assembled view of conductive members of the electrical connector in FIG. 12.

During assembly, after the first main body 10 and the second main body 20 are combined, the second main body 20 is rotated to a second position where the second main body 20 is at an angle of 0° from the first main body 10 (see FIG. 12, i.e., the vertical position, and the positions of conductive members are as shown in FIG. 15), and the casing 40 is covered, so that the buckling portions 411 are hooked to the lower part of the base 110 (see FIG. 14), and the two are fixed. At the same time, the stopping surface 409 is adjacent to the top surface of the base 110 (or other parts of the first main body 10), and the limiting portion 407 is adjacent to the outer side of the second main body 20, so as to prevent the second main body 20 from rotating, thereby maintaining the second main body 20 at the second position (see FIG. 13).

In the above description, only the two positions where the first main body 10 is at 0° and 90° from the second main body 20 are illustrated. However, since the second main body 20 is capable of rotating relative to the first main body 10 between 0° and 90°, the second main body 20 can be maintained at any position between the first position and the second position, which can be achieved simply by modifying the structure of the casing (the casing may be replaced by other fixing structures to maintain the position of the second main body), while keeping the first main body and the second main body unchanged. Therefore, the method of separately manufacturing the same parts of the same type at different angles can save the cost of molds and satisfy the flexible demands of customers.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a first main body, comprising a first insulating body and a first conductive member set fixed to the first insulating body, wherein each conductive member of the first conductive member set comprises a first fixing portion fixed to the first insulating body, and a first internal connecting portion and a first external connecting portion respectively extending from two opposite ends of the first fixing portion, and wherein the first internal connecting portion of each conductive member of the first conductive member set comprises two arms, and the two arms have opposite surfaces forming contact surfaces; and a second main body, comprising a second insulating body and a second conductive member set fixed to the second insulating body, wherein each conductive member of the second conductive member set has a second internal connecting portion, a second external connecting portion and a second fixing portion defined between the second internal connecting portion and the second external connecting portion wherein the second fixing portion is fixed to the second insulating body, the second internal connecting portion of each conductive member of the second conductive member set is in a flat plate shape with a plate surface forming a contact surface, and the second internal connecting portion of each conductive member of the second conductive member set is in contact with the first internal connecting portion of the corresponding conductive member of the first conductive member set respectively;

wherein the second main body is movably mounted on the first main body and is capable of rotating relative to the first main body, and during rotation, each of the second internal connecting portions is maintained in contact with the corresponding first internal connecting portion.

2. The electrical connector according to claim 1, wherein both the first conductive member set and the second conductive member set are formed in at least two rows, inner conductive members of the first conductive member set are in contact with inner conductive members of the second conductive member set respectively, and outer conductive members of the first conductive member set are in contact with outer conductive members of the second conductive member set respectively.

3. The electrical connector according to claim 2, wherein the first internal connecting portion of the outer conductive member of the first conductive member set unfolds outwards at a position near the first fixing portion, so as to form a space capable of receiving the second internal connecting portion of the inner conductive member of the second conductive member set.

4. An electrical connector, comprising:

a first main body, having a first insulating body and two rows of first conductive members fixed to the first insulating body; and a second main body, having a second insulating body and two rows of second conductive members fixed to the second insulating body, wherein the second main body is movably mounted on the first main body and is capable of rotating between a first position and a second position relative to the first main body, and during rotation, each of the second conductive members is maintained in contact with the corresponding first conductive member; and a casing, fixed on the first main body so that the second main body is maintained at a position between the first position and the second position.

5. The electrical connector according to claim 1, wherein the rotation mechanism for enabling the second main body to rotate relative to the first main body comprises rotating slots configured on the first insulating body and rotating shafts correspondingly configured on the second insulating body.

6. The electrical connector according to claim 5, wherein two ends of a top surface of the first insulating body respectively extend vertically upwards to form two opposing claws, the two claws form the rotating slot, and tail ends of the two claws extend towards each other to form an opening having a size smaller than the diameter of the rotating shaft and for engaging the rotating shaft therein.

7. The electrical connector according to claim 5, wherein the rotating shaft comprises a shaft portion extending outwards from two sides of the main body of the second insulating body and a flange portion extending from a tail end of the shaft portion, and the width of the rotating slot is greater than the diameter of the shaft portion but is smaller than the width of the flange portion.

8. The electrical connector according to claim 1, wherein the first insulating body is provided with a plurality of receiving housings for receiving the first internal connecting portions of the first conductive member set and the second internal connecting portions of the second conductive member set, and each receiving housing is opened upwards and then forwards to provide a space for the second internal connecting portion to rotate.

9. The electrical connector according to claim 8, wherein the first insulating body comprises a base and a core fixed to the base, the base fixes the first conductive member set, and the core is provided with the receiving housings.

10. The electrical connector according to claim 1, wherein an arc-shaped surface is formed at a junction between a front end surface and a top surface of the first insulating body, so as to support the second insulating body when the second main body rotates.

11. An electrical connector, comprising:

a first main body, comprising a first insulating body and a first conductive member set fixed to the first insulating body, wherein each conductive member of the first conductive member set comprises a first fixing portion fixed to the first insulating body, and a first internal connecting portion and a first external connecting portion respectively extending from two opposite ends of the first fixing portion;

a second main body, comprising a second insulating body and a second conductive member set fixed to the second insulating body, wherein each conductive member of the second conductive member set has a second internal connecting portion, a second external connecting portion, and a second fixing portion defined between the second internal connecting portion and the second external connecting portion, wherein the second fixing portion is fixed to the second insulating body, and the second internal connecting portion of each conductive member of the second conductive member set is in contact with the first internal connecting portion of the corresponding conductive member of the first conductive member set respectively, and wherein the second main body is movably mounted on the first main body and is capable of rotating relative to the first main body, and during rotation, each of the second internal connecting portions is maintained in contact with the corresponding first internal connecting portion; and a casing, fixed on the first main body so that the second main body is maintained at a predetermined position.

12. The electrical connector according to claim 11, wherein the casing comprises a plate body and arms extending downwards from two ends of the plate body, a front end of the plate body is provided with a limiting portion adjacent to a back side of the second main body, and a bottom of the arm is provided with a stopping surface adjacent to the first main body.

13. The electrical connector according to claim 12, wherein the two arms are each provided with a hook portion for being hooked and fixed to the second insulating body.

14. The electrical connector according to claim 11, wherein the casing is a frame hollowed out from top to bottom, and comprises a front plate, a back plate and two side plates connecting the front plate and the back plate, the front plate is provided with a limiting portion adjacent to an outer side of the second main body, and a bottom of the side plate is provided with a stopping surface adjacent to the first main body.

15. The electrical connector according to claim 14, wherein the front plate and the back plate are respectively provided with a buckling portion for being buckled and fixed to the first main body.

16. The electrical connector according to claim 4, wherein at the first position, the second main body is at an angle of 90° from the first main body, and at the second position, the second main body is at an angle of 0° from the first main body.

* * * * *